US008058782B2

(12) United States Patent
Lai

(10) Patent No.: US 8,058,782 B2
(45) Date of Patent: Nov. 15, 2011

(54) BULB-TYPE LED LAMP

(75) Inventor: Chyi-Lang Lai, Taipei Hsien (TW)

(73) Assignee: Chicony Power Technology Co., Ltd., Taipei (TW)

( * ) Notice: Subject to any disclaimer, the term of this patent is extended or adjusted under 35 U.S.C. 154(b) by 43 days.

(21) Appl. No.: 12/720,776

(22) Filed: Mar. 10, 2010

(65) Prior Publication Data

US 2011/0221322 A1 Sep. 15, 2011

(51) Int. Cl.
*H01J 61/52* (2006.01)
*F21V 29/02* (2006.01)

(52) U.S. Cl. ..... 313/46; 313/512; 362/800; 362/294; 362/373; 362/126

(58) Field of Classification Search ..... None
See application file for complete search history.

(56) References Cited

U.S. PATENT DOCUMENTS

| | | | | |
|---|---|---|---|---|
| 7,344,279 | B2 * | 3/2008 | Mueller et al. | 362/294 |
| 2003/0040200 | A1 * | 2/2003 | Cao | 438/800 |
| 2011/0074271 | A1 * | 3/2011 | Takeshi et al. | 313/46 |
| 2011/0095690 | A1 * | 4/2011 | Sagal | 315/113 |
| 2011/0128742 | A9 * | 6/2011 | Yuen et al. | 362/294 |

* cited by examiner

*Primary Examiner* — Ashok Patel
(74) *Attorney, Agent, or Firm* — Chun-Ming Shih; HDLS IPR Services

(57) ABSTRACT

A bulb-type LED lamp includes a cooling structure, an LED module, a transparent shade and a lamp head. The cooling structure includes a thermally conductive plate and a plurality of cooling fins configured by being bended upwardly from a periphery of the thermally conductive plate, and each cooling fins are disposed by being interspaced to each other. The LED module is attached onto a bottom face of the thermally conductive plate. The transparent shade covers the LED module correspondingly and is connected fixedly to the thermally conductive plate. The lamp head is fitted and connected to each cooling fin and electrically connected to the LED module. Thereby, the thermal convection is enhanced and the cooling efficiency is further promoted.

9 Claims, 5 Drawing Sheets

BULB-TYPE LED LAMP

BACKGROUND OF THE INVENTION

1. Field of the Invention

The present invention in general relates to a lighting device, in particular, to a bulb-type LED lamp and a cooling structure thereof.

2. Description of Prior Art

Common incandescent bulb takes tungsten filament as lighting source, so the structure is simple, and the arrangement and exchange therefor are very convenient. In the structure of an incandescent bulb, a tail end of the spherical shade is usually fixedly connected an adapter, on which there are threads adapted to be screwed in a common bulb socket. When power is conducted, the tungsten filament arranged in the shade can emit heat and light, and the light shines outwardly via the shade to reach a lighting purpose. However, during the operation when the tungsten filament generates illuminating light, a large amount of heat is also generated. Therefore, this kind of lighting device is very power-consuming and energy wasting, and has very short lifespan because the tungsten filament is easily burned to black out the incandescent bulb.

LED, a kind of lighting source in solid state, can transfer electricity into light. In the meantime, LED has the merits of small size, low driving voltage, quick reaction speed, vibration resistance and long lifespan. Besides, following the continuity of development and progress of technology, the trend of electronic component is toward compactness, such that the bulb-type LED lamp has gradually replaced the incandescent bulb to become a lighting device that is applied in large amount and comprehensively.

According to prior arts, a bulb-type LED lamp mainly includes a circuit board, a plurality of LEDs electrically connected to the circuit board, a transparent shade covering each LED, an aluminum-extruded cooling seat attached by the circuit board and an adapter fixed to the aluminum-extruded cooling seat. However, since the cooling efficiency of the aluminum-extruded cooling seat is decided by the surface area thereof, and because the surrounding air can only make heat exchange with the surface of the aluminum-extruded cooling seat, the cooling efficient is limited and the cooling speed is slow, further influencing the working performance of this kind of bulb-type LED lamp.

Accordingly, after a substantially devoted study, in cooperation with the application of relative academic principles, the inventor has finally proposed the present invention designed reasonably to possess the capability to improve the drawbacks of the prior arts significantly.

SUMMARY OF THE INVENTION

Therefore, in order to solve aforementioned problems, the invention is mainly to provide a bulb-type LED lamp and a cooling structure thereof, which can enhance thermal convection and further promote cooling efficiency.

Secondly, the invention is to provide a bulb-type LED lamp, including:

a cooling structure, which includes a thermally conductive plate and a plurality of cooling fins configured by being bended upwardly from a periphery of the thermally conductive plate, and each cooling fins are disposed by being interspaced to each other;

an LED module, which is attached onto a bottom face of the thermally conductive plate; and a lamp head, which is fitted and connected to each cooling fin and electrically connected to the LED module.

Thirdly, the invention is to provide another kind of technical means in which the bulb-type LED lamp further includes an LED module, the cooling structure including:

a thermally conductive plate, which has a bottom plate adapted to be attached by the LED module LED lamp; and a plurality of cooling fins, which are configured by being bended upwardly from a periphery of the thermally conductive plate, and which are arranged by being interspaced to each other.

Compared to prior arts, the invention has following merits. First of all, surrounding air can freely flow among the cooling fins to make heat exchange sufficiently, so the cooling effect is enhanced due to the thermal convection, and the cooling speed is accelerated. In the meantime, the working performance of the bulb-type LED lamp is promoted and less material is used by the cooling structure. Therefore, the manufacturing cost is reduced and the entire weight is lightened, making the invention has a significant economic effect.

BRIEF DESCRIPTION OF DRAWING

The features of the invention believed to be novel are set forth with particularity in the appended claims. The invention itself, however, may be best understood by reference to the following detailed description, which describes an embodiment of the invention, taken in conjunction with the accompanying drawings, in which:

DETAILED DESCRIPTION OF THE INVENTION

Figure 1:
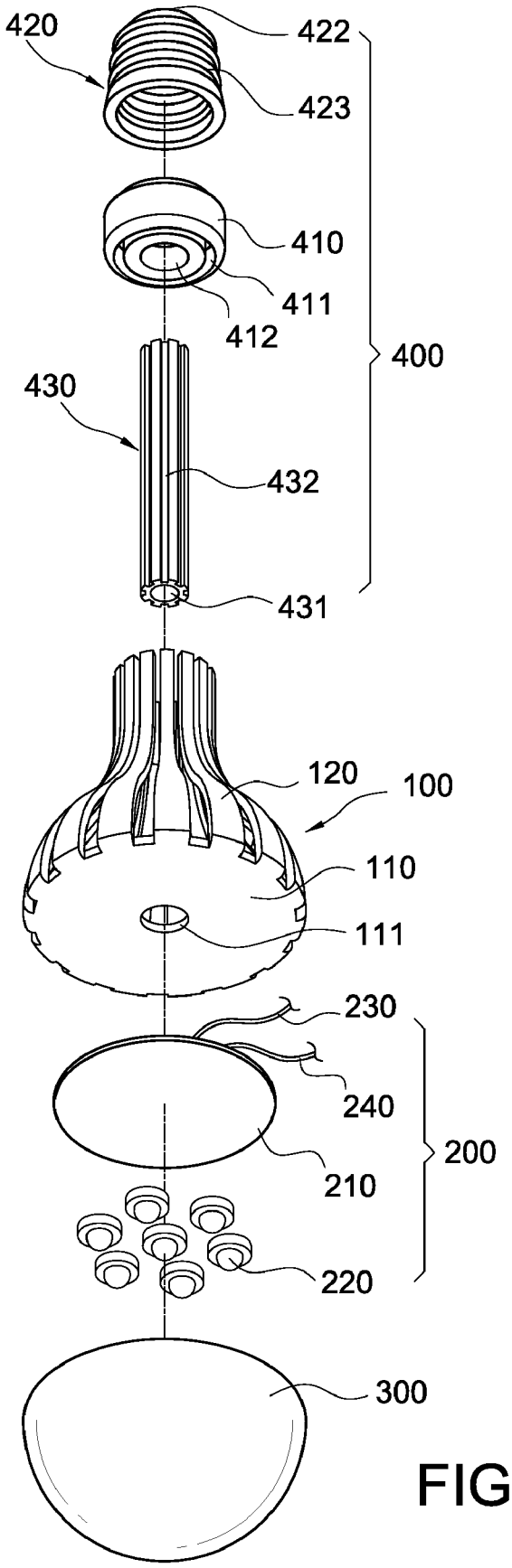
FIG. 1 is a perspective explosive illustration of the invention.
Figure 2:
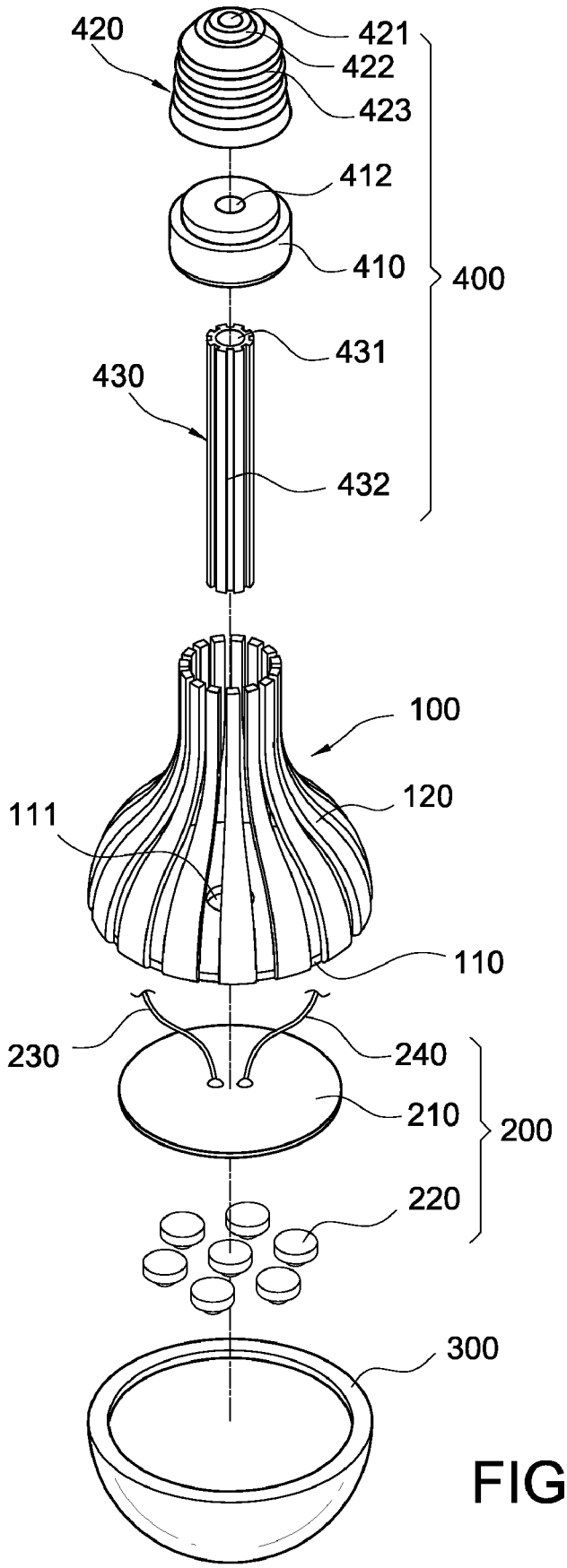
FIG. 2 is another viewing angle of FIG. 1.
Figure 3:
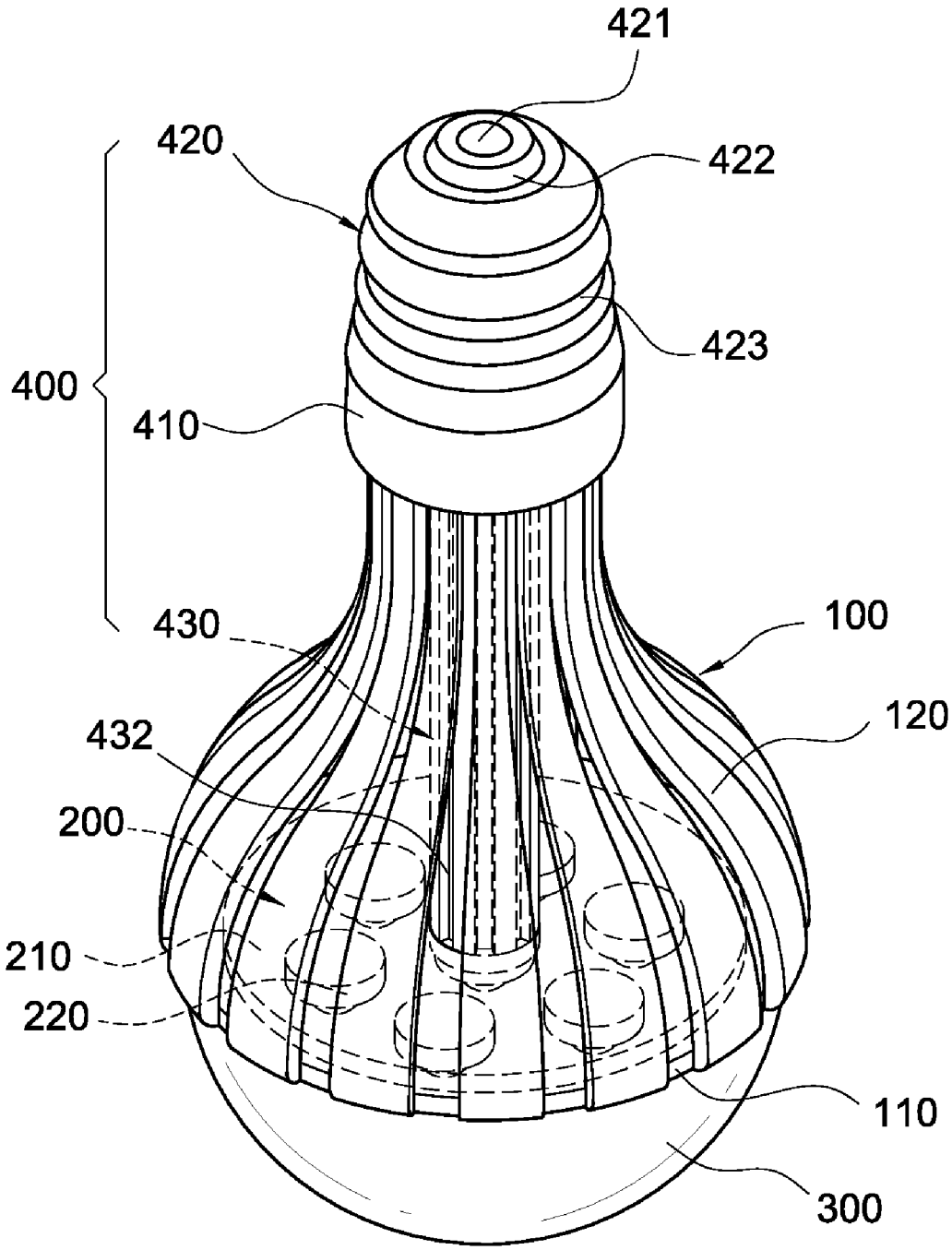
FIG. 3 is a perspective assembled illustration of the invention.
Figure 4:
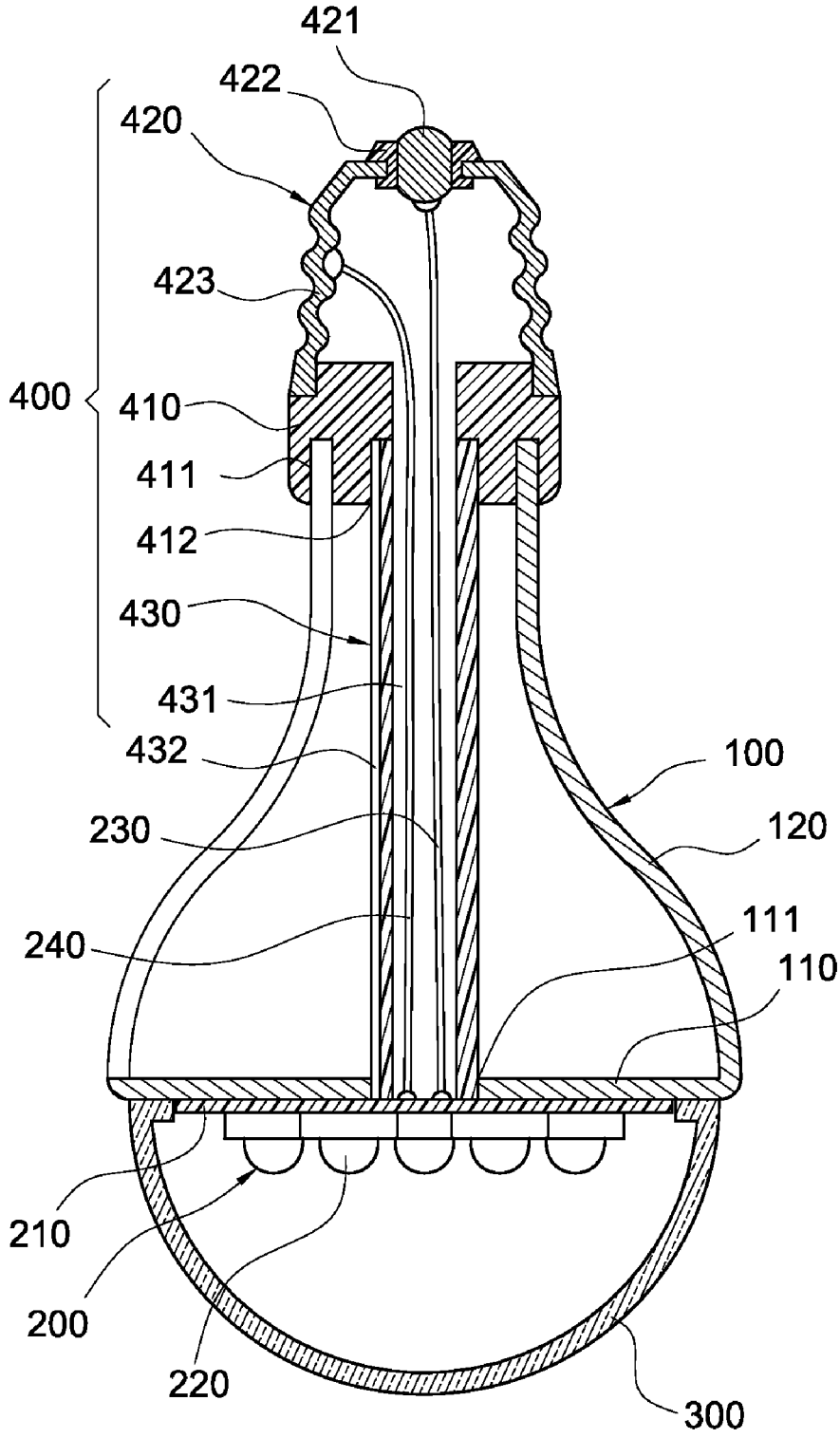
FIG. 4 is a lateral sectional view of FIG. 4.

In cooperation with attached drawings, the technical contents and detailed description of the present invention are described thereinafter according to a preferable embodiment, not used to limit its executing scope. Any equivalent variation and modification made according to appended claims is all covered by the claims claimed by the present invention.

As shown in FIG. 1 through FIG. 4, the invention is mainly to provide a bulb-type LED lamp and a cooling structure thereof, the bulb-type LED lamp including: a cooling structure 100, an LED module 200, a transparent shade 300 and a lamp head 400.

The cooling structure 100 includes a thermally conductive plate 110 and a plurality of cooling fins 120. These cooling fins 120 are entirely configured as a lateral periphery to the thermally conductive plate 110 and are interspaced to each other to be formed a ring-like array around the periphery of the thermally conductive plate 110. The configuration pattern of these cooling fins 120 is described as the follows. First of all, the cooling fins 120 are extended outwardly from the periphery of the surface of thermally conductive plate 110 in a radial directions and in the meantime, bended to one side of the thermally conductive plate 110. The thermally conductive plate 110 and the cooling fins 120 can be made integrally by means of stamping process, however, not limited to this kind of formation only. The thermally conductive plate 110 and the cooling fins 120 are made of materials with excellent thermal conductivity, like metal, however, not limited to this kind of material only. In addition, a perforation 111 penetrates the center of the thermally conductive plate 110.

The LED module 200 includes a circuit substrate 210, a plurality of LEDs, a first wire 230 and a second wire 240.

On the circuit substrate 210, there is a printed circuit made of material with excellent electric conductivity. A thermally insulated layer (not shown in the figures) is coated on one face of the circuit substrate 210. With the face of the thermally insulated layer, the circuit substrate 210 is attached to another side of the thermally conductive plate 110, such that a short-circuited phenomenon can be avoided between the circuit substrate 210 and the bottom face of the thermally conductive plate 110.

The LEDs 220 are separately disposed on the circuit substrate 210 by the jointing manners of wire bonding and flip chip, whereby the LEDs 220 are electrically connected to the printed circuit of the circuit substrate 210. However, the jointing manner is not limited to the aforementioned ones. Besides, the light projecting direction of the LEDs is opposite to the extension direction of the cooling fin 120.

The first wire 230 and the second wire 240 are respectively electrically connected to the circuit substrate 210 and are fixed by passing through the perforation 111.

The transparent shade 300 is connected fixedly to the thermally conductive plate 110 and covers the LED module 200, such that the LEDs 200 are sealed and provided with a protection function. The transparent shade 300 can be connected fixedly to the thermally conductive plate 110 by means of wedge, screw and glue, however, not limited to these manners only. In addition, a diffusive layer (not shown in the figures) is coated on the transparent shade 300 to transfer the direct light beam of the LED 200 into a light beam of wide diffusive light beam to widen the entire lighting range.

The lamp head 400 includes a converging piece 410, an electrically connecting body 420 and a hollow tube 430.

The converging piece 410 is made of insulation material, like plastic, however, not limited to this kind material only. The periphery of the converging piece 410 is arranged a ring groove 411, into which the end sides of the cooling fins 120 are separately inset. The converging piece 410 can be fitted by receiving these cooling fins 120, such that the cooling structure 100 is further sturdy. In the meantime, the cooling fins 120 are gradually converged from the thermally conductive plate 110 toward the converging piece 410, such that the entire volume of the bulb can be reduced. In addition, a through hole 412 is arranged by penetrating the center of the converging piece 410 and adapted for the respective penetration of the first wire 230 and the second wire 240.

The electrically connecting body 420 is substantially shown as a cup shape, on which an end part 421, an insulation part 422 and a threaded part 423 are separately formed. The end part 421 and the threaded part 423 are made of electrically conductive material, like metal, however, not limited to this kind of material only. Furthermore, a thread is formed around the threaded part 423 and adapted for being screwed in a common bulb socket, while the insulation part 422 is formed between the end part 421 and the threaded part 423 and adapted for an insulating separation between the end part 421 and the threaded part 423. The electrically connecting body 420 is connected fixedly onto the converging piece 410 by the threaded part 423 by means of wedge, thread or glue, however, not limited to these manners only. In this case, the first wire 230 is electrically connected to the end part 421, while the second wire 240 is electrically connected to the threaded part 423.

Two ends of the hollow tube 430 respectively pass through the perforation 111 and the through hole 412. The hollow tube 430 has a hole 431 provided for the first wire 230 and the second wire 240 to pass through, whereby the hollow tube 430 can converge the first wire 230 and the second wire 240 and provide a protection function. In the meantime, there are a plurality of ditch grooves 432 arranged at the outside of the hollow tube 430 for increasing the surface area of the hollow tube 430, such that the cooling performance is promoted.

Figure 5:
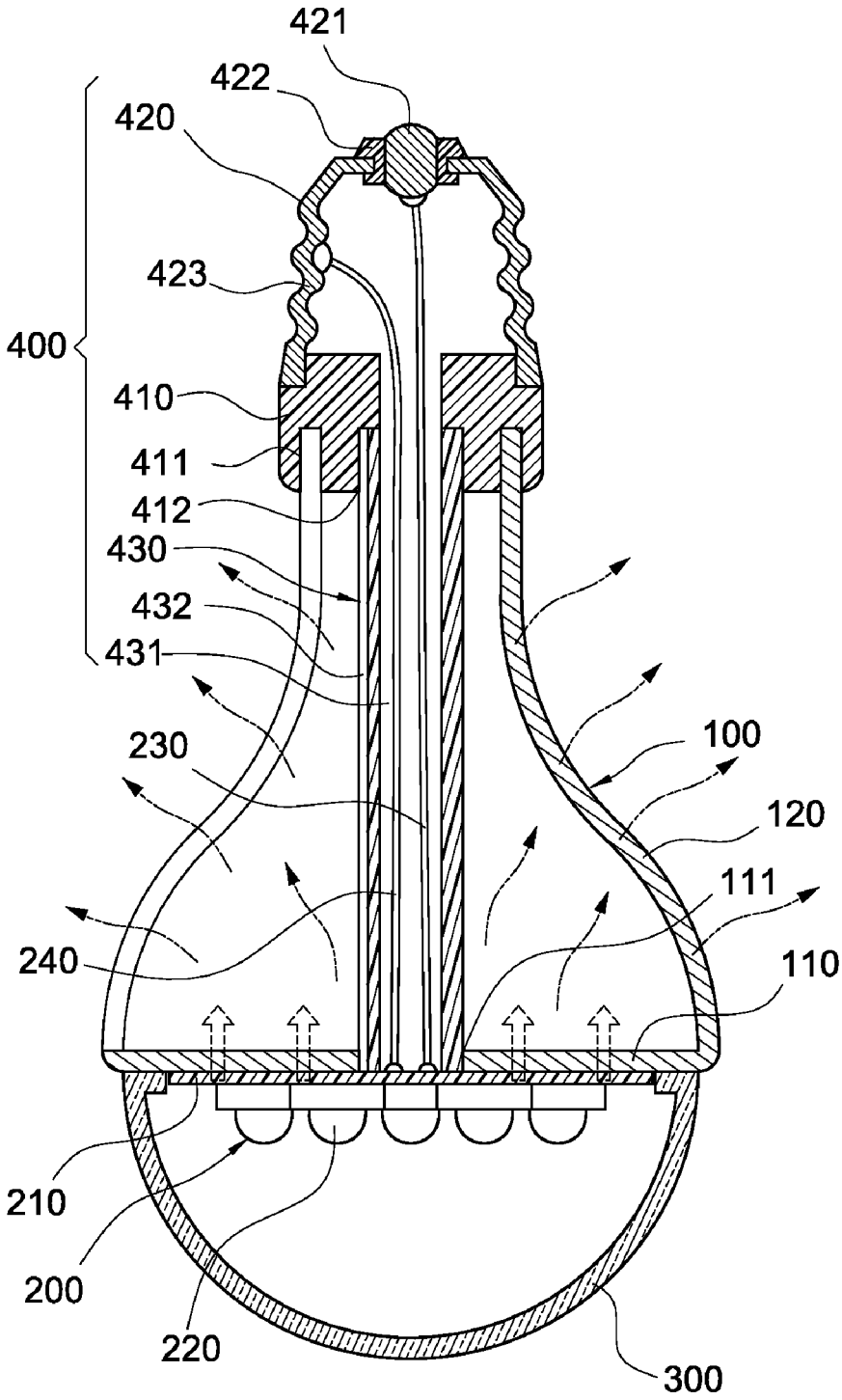
FIG. 5 is a using status illustration of the invention.

Continuously, please refer to FIG. 5, in which the threaded part 423 of the lamp head 400 can be screwed in a common bulb seat and compatible to the common bulb seat without changing the entire set, so the invention significantly has the merits of practicability and convenience. In other words, the end part 421 is electrically connected to the positive pole of common bulb socket, while the threaded part 423 is electrically connected to the negative pole of common bulb socket in a way, such that a current loop is formed among the circuit substrate 210, the thirst wire 230 and the second wire 240, whereby the LEDs 220 are electrified and emits light beam.

During the operation period when the LEDs 220 emit light beam, a large amount of heat is also generated from the LEDs 220 and the circuit substrate 210. The heat is conducted to the thermally conductive plate 110 from the LEDs 220 and the circuit substrate 210 and further conducted to the cooling fins 120 and the hollow tube 430 via the thermally conductive plate 110. By a heat exchange between the surrounding cool air and the cooling fins 120 and the hollow tube 430, the heat generated from the LEDs 220 and the circuit substrate 210 are dissipated to the ambience.

Because of the gaps among the cooling fins 120, a lot of hollow space can be available in the hollow tube 430 and among the cooling fins 120, effectively making the surrounding air flow freely among the gaps and in the space. Thereby, the heat can be dissipated quickly, because of the accelerative cooling function created by the thermal convection. Not only the cooling efficiency is thereby promoted, but the material of the cooling structure is reduced, so is the weight lightened, by comparison with the prior arts. Because of the reduction of material cost and the decrease of entire weight, the invention has a significant effect of economy.

Therefore, through the constitution of aforementioned assemblies, a bulb-type LED lamp and a cooling structure thereof according to the present invention is thus obtained.

Summarizing aforementioned description, the bulb-type LED lamp with cooling structure according to the present invention is an indispensable device and design for a lighting industry indeed, which may positively reach the expected usage objective for solving the drawbacks of the prior arts, and which extremely possesses the innovation and progressiveness to completely fulfill the applying merits of a new type patent, according to which the invention is thereby applied. Please examine the application carefully and grant it as a formal patent for protecting the rights of the inventor.

However, the aforementioned description is only a preferable embodiment according to the present invention, not used to limit the patent scope of the invention, so equivalently structural variation made to the contents of the present invention, for example, description and drawings, is all covered by the claims claimed thereinafter.

What is claimed is:

1. A bulb-type LED lamp, including:

a cooling structure, which includes a thermally conductive plate and a plurality of cooling fins configured by being bended upwardly from a periphery of the thermally conductive plate, each cooling fins being disposed by interspacing to each other;

an LED module, which is attached onto a bottom face of the thermally conductive plate; and a lamp head, which is fitted and connected to each cooling fin and electrically connected to the LED module.

2. The bulb-type LED lamp according to claim 1, wherein an extending direction of the cooling fin is opposite to a light projecting direction of the LED module.

3. The bulb-type LED lamp according to claim 1, wherein the thermally conductive plate and the cooling fins are formed integrally.

4. The bulb-type LED lamp according to claim 1, wherein the lamp head includes a converging piece in which a ring groove is arranged, and the ring groove is adapted for the cooling fins being separately inserted therein.

5. The bulb-type LED lamp according to claim 1, wherein the LED module includes a circuit substrate attached onto another side of the thermally conductive plate, a plurality of LEDs disposed on the circuit substrate and electrically connected thereto, and a first wire and a second wire respectively electrically connected to the circuit substrate, and the thermally conductive plate is arranged a perforation adapted for the first wire and the second wire to pass through, and the lamp head includes a converging piece adapted for fitting and converging the cooling fins, and the converging piece is arranged a through hole adapted for the first wire and the second wire to pass through.

6. The bulb-type LED lamp according to claim 5, further including a hollow tube, wherein two ends of which are respectively inset into the perforation and the through hole, and which has a hole adapted for the first wire and the second wire to pass through, and on an outside of which a plurality of ditch grooves are arranged.

7. The bulb-type LED lamp according to claim 1, wherein the LED module includes a circuit substrate attached onto another side of the thermally conductive plate, a plurality of LEDs disposed on the circuit substrate and electrically connected thereto, and a first wire and a second wire respectively electrically connected to the circuit substrate, and the lamp head includes a converging piece adapted for fitting and converging the cooling fins and a electrically connecting body connected fixedly to the converging piece and electrically connected to the circuit substrate.

8. The bulb-type LED lamp according to claim 7, wherein the electrically connecting body has an end part adapted for the first wire electrically connected thereto, a threaded part connected fixedly to the converging piece and adapted for the second wire electrically connected thereto and an insulation part formed between the end part and the threaded part.

9. The bulb-type LED lamp according to claim 1, further including a transparent shade covering the LED module correspondingly and connected fixedly to the thermally conductive plate.

* * * * *